US006345577B1

(12) United States Patent
Cramer et al.

(10) Patent No.: US 6,345,577 B1
(45) Date of Patent: Feb. 12, 2002

(54) ENERGETIC DETERRENT COATING FOR GUN PROPELLANT

(75) Inventors: Randall J. Cramer; Susan Peters, both of Arlington, VA (US); Ronald Simmons; Steve Mitchell, both of La Plata, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/670,338

(22) Filed: Sep. 27, 2000

(51) Int. Cl.[7] ..... C06D 5/06
(52) U.S. Cl. ..... 102/290; 102/288; 102/289
(58) Field of Search ..... 102/288, 289, 102/290

(56) References Cited

U.S. PATENT DOCUMENTS

| | | | | |
|---|---|---|---|---|
| 1,627,863 A | | 5/1927 | O'Neil | |
| 1,882,190 A | | 10/1932 | Pritchett | |
| 1,932,050 A | | 10/1933 | Spaeth | |
| 2,079,558 A | | 5/1937 | Lindsley | 52/17 |
| 2,615,800 A | | 10/1952 | Goodale | 52/11 |
| 3,304,211 A | | 2/1967 | Anderson et al. | 149/11 |
| 3,667,524 A | | 6/1972 | Paustian et al. | 149/8 |
| 3,753,810 A | | 8/1973 | Leneveu et al. | 149/8 |
| 3,762,969 A | * | 10/1973 | Sayles | 102/289 X |
| 3,855,022 A | | 12/1974 | Flynn | 149/8 |
| 4,094,710 A | | 6/1978 | Boyars et al. | 149/3 |
| 4,350,542 A | | 9/1982 | Kincaid et al. | 149/11 |
| 4,389,263 A | | 6/1983 | Allen | 149/11 |
| 4,530,728 A | * | 7/1985 | Sayles | 102/289 X |
| 4,881,464 A | * | 11/1989 | Sayles | 102/290 X |
| 4,950,342 A | | 8/1990 | Canterberry | 179/10 |
| 5,325,782 A | * | 7/1994 | Strauss et al. | 102/290 X |
| 5,467,715 A | * | 11/1995 | Taylor et al. | 102/289 |
| 5,682,009 A | * | 10/1997 | O'Meara et al. | 102/289 X |

* cited by examiner

*Primary Examiner*—Peter A. Nelson
(74) *Attorney, Agent, or Firm*—Mark Homer

(57) ABSTRACT

Propellant compositions are coated with an energetic deterrent coating which reduces the burning rate at the surface of the propellant grain and causes the propellant to burn progressively. The use of energetic materials, that are slightly soluble in the coating solvent, improve the burning properties of the propellant without decreasing the chemical energy.

17 Claims, No Drawings

ENERGETIC DETERRENT COATING FOR GUN PROPELLANT

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefore.

BACKGROUND OF THE INVENTION

1. Field of the Invention

The present invention relates to coating gun propellant grains with a slow burning energetic material for use as a deterrent coating. More particularly, the slow burning energetic material improves the progressivity of conventional gun propellants without reducing the gun propellants chemical energy.

2. Brief Description of the Related Art

Soluble low-energy or inert materials, such as dibutyl phthalate, methyl centralite, triacetin and paraplex, have conventionally been used as propellant grain deterrent coatings. Lower burning rates are achieved through use of these low-energy or inert plasticizers. These materials improve the burning properties of the propellant grain by allowing the propellant to burn faster later in the ballistics cycle. While these inert materials lower the burning rate of the gun propellant, the materials decrease the chemical energy of the propellant due to their low energy content which diminishes the total chemical energy of the propellant, thus reducing the overall performance of the propellant.

In view of the foregoing, there is a need in the art to improve the burning properties of conventional gun propellants without decreasing the energy of the propellant. The present invention addresses this and other needs.

SUMMARY OF THE INVENTION

Energetic materials are used as a deterrent coating material for gun propellant.

The present invention includes a gun propellant composition comprising a gun propellant grain component and an energetic deterrent coating composed of at least one slow burning material coated onto the propellant grain component, wherein the at least one slow burning energetic material reduces the burn rate at the surface of the propellant grain and causes the propellant to burn progressively.

The present invention also includes a method of manufacturing a gun propellant composition having an energetic deterrent coating comprising the steps of forming a propellant grain component, dissolving an energetic deterrent coating into a solvent and applying the dissolved energetic deterrent onto the formed propellant grain.

Additionally, the present invention includes a gun propellant composition product made by the process comprising the steps of providing a gun propellant composition having a propellant grain component and an energetic deterrent coating composed of at least one slow burning energetic material coated onto the propellant grain component, wherein the at least one slow burning energetic material reduces the burn rate at the surface of the propellant grain and causes the propellant to burn progressively and burning the gun propellant.

DETAILED DESCRIPTION OF THE PREFERRED EMBODIMENT

The present invention includes a gun propellant composition having an energetic deterrent coating on the outside of a propellant grain component. The present invention improves the progressivity of conventional gun propellants by incorporating a slow burning energetic material as deterrent coatings onto propellant grains. Through the use of an energetic material, the burning properties of the propellant grain are improved without the loss of chemical energy.

The propellant grain component may include single base, double base, triple base, nitramine, or other like propellants. Propellants having abase of nitrocellulose are generally referred to as single base propellants. Mixtures of nitrocellulose and nitroglycerin are referred to as a double base propellant. When the base is a mixture of nitrocellulose, nitroglycerin and nitroguanidine, the propellant is referred to as a triple base propellant. Propellants may also comprise a binder component and a nitramine. The nitramine is usually present in an amount from 30% to 85% by weight depending upon the propellant characteristics desired. Typical nitramine used in gun propellant formulations is cyclotrimethylenetrinitramine (RDX). The configuration of the propellant grain, usually cylindrical, can vary in diameter and length, preferably ranging from about 0.25 inches to about 1.0 inch, and preferably having one or more perforations, preferably ranging from about one perforation (single-perf) to about 19 perforations (19-perf).

The propellant binder can be selected from those binders known in the art such as single-base binders, double-base binders or inert binders plasticized with energetic plasticizers. Gun propellant binders having a wide range of burning rates are available with the proper selection of binder determinable by those skilled in the art in light of the disclosure herein. Energetic plasticizers can be compounded with the inert binders in amounts up to 50% to 60% by weight. Representative energetic plasticizers are organic nitrates such as triethylene glycol dinitrate (TEGDN), trimethylol ethane trinitrate (TMETN), nitroglycerine (NG), and the like.

The energetic deterrent coating of the present invention comprises at least one slow burning energetic material. These slow burning energetic materials reduce the burn rate at the surface of the propellant grain and cause the propellant to bum progressively. The energetic deterrent coating comprises a crystalline solid. Preferably these crystalline solids comprise one or more organic compounds which exhibit a fast self-sustaining chemical reaction that releases large quantities of heat and energy. Self-sustaining compounds are those compounds that sustain a chemical reaction without requiring additional oxidizer or fuel. Organic compounds useful in energetic deterrent coatings of the present invention preferably include compounds possessing amino, nitro, nitroamino, hydrazino, azido, nitroxyethylamino, and nitroxyethylnitramino functional groups.

Suitable energetic materials preferably include high nitrogen compounds such as dihydrazine tetrazine, insensitive munitions materials such as 2,6-diamino-3,5-dinitropyrazine-1-oxide, diaminodinitroethylene, analogs of 1,3,5-triamino-2,4,6-trinitrobenzene (TATB), and other like slow burning energetic materials, including for example dihydrazinotetrazene (HZTZ), 1,3,5-tris(2-nitroxyethylamino)-2,4,6-triniobenzene (PITNE), and 1-(2-nitroxyethylamino)-3-(2-nitroxyethylnitramino)-2,4,6-trinitrobenzene (PINANE). Other useful energetic materials of the present invention which have good energy, and acceptable burning rates, and are slightly soluble in appropriate coating solvents include, but are not limited to diamino dinitropyrazine-1-oxide (LLM-105) and diamino dinitroethylene (FOX-7). Preferred energetic materials include HZTZ, TATB, PINANE, PITNE, LLM-105 and FOX-7.

TABLE 1.

Organic Energetic Deterrent Coatings Compounds

| Energetic Deterrent | Chemical Name | Chemical Formula | % Nitrogen | Density (g/cc) | Hear for Formation (kcal/mol) |
|---|---|---|---|---|---|
| HZTZ | Dihydrazinotetrazine | $C_2H_6N_8$ | 78 | 1.68 | +128 |
| TATB | Triaminorinitrobenzene | $C_6H_6N_6O_6$ | 32 | 1.93 | ±35 |
| PINANE | Nitroxyethylamino Nitroxyethylnitramino) Trinitrobenzene | $C_{10}H_{11}N_7O_{12}$ | 23 | 1.74 | — |
| PITNE | Tris(2-nitroxyethylamino) Trinitrobenzene | $C_{12}H_{15}N_9O_{15}$ | 24 | 1.69 | — |
| LLM-105 | Diamino Dinitropyrazine-1-oxide | $C_4H_4N_6O_5$ | 39 | 1.91 | −3 |
| FOX-7 | Diamnio Dinitroethylene | $C_2H_4N_4O_4$ | 38 | 1.88 | −30 |

Preferably, the energetic deterrent coating comprises a high density deterrent. High density, high energy materials that exhibit some solubility in low volatility solvents may be used. High density deterrents, for the purposes of the present invention, include a density of from about 1.6 g/cm$^3$ or greater, with preferred densities of from about 1.6 g/cm$^3$ to about 2.0 g/cm$^3$. For proper application of the energetic deterrent coating, the slow burning energetic material comprises a soluble material. Solubility of the slow burning energetic material preferably ranges from about 0.05 percent weight per weight of solvent or greater, with a more preferred range of from about 0.05 percent weight per weight of solvent to about 5 percent weight per weight of a solvent. Useful solvents are compositions that are not detrimental to propellant grain integrity, and include without limitation, water, alcohol, ether, ethyl acetate and acetone. The proper selection of solvent for a given slow burning energetic material and propellant grain is determinable by those skilled in the art. Solvents preferably are used in amounts of up to about 75% for water, up to about 50% for alcohol, and up to about 25% for ether, ethyl acetate or acetone. Selection is determined based on the solubility and the absorption properties of the propellant binder.

The energetic deterrent coating sufficiently penetrates the propellant grain to cause burning rate alterations. Preferably, the propellant composition possesses an energetic deterrent coating that penetrates into the surface of the propellant grain component a distance of from about 0.05 inch to about 0.25 inch. Amounts of energetic deterrent coating in the propellant composition generally range from about 0.05 percent weight/weight to about 30 percent weight/weight of the propellant composition, with preferred amounts ranging from about 0.05 percent weight/weight to about 25 percent weight/weight of the propellant composition, more preferred amounts ranging from about 0.05 percent weight/weight to about 20 percent weight/weight of the propellant composition, and most preferred amounts ranging from about 0.05 percent weight/weight to about 15 percent weight/weight of the propellant composition. Burn rates are significantly reduced, such as from about 300% (3 to 1 ratio) to about 200% (2 to 1 ratio).

The gun propellant composition of the present invention is manufactured by forming a propellant grain component and applying a dissolved energetic deterrent coating onto the propellant grain. After the energetic deterrent is dissolved into an appropriate solvent, the dissolved energetic deterrent and formed propellant grain component are heated under vacuum to remove the solvent, at which time the dissolved energetic deterrent coating is applied onto the formed propellant grain component. The dissolved energetic deterrent may be applied by immersion, spraying, stirred in a slurry of the coating materials and solvent, or other suitable contact of the dissolved energetic deterrent onto the surface of the propellant grain component. Both solid and perforated grains can be coated in this manner. Excess solvent may be gradually removed with additional heat and/or the application of a vacuum, resulting in coated propellant grains. The method produces a gun propellant composition that provides a reduced burn rate at the surface of the propellant grain and causes the propellant to burn progressively during gun propellant burn.

EXAMPLE 1

In a 100 ml round bottom flask, 50.0 grams of Ex-99 RDX based nitramine gun propellant, 1.5 grams dihydrazinotetrazene (HZTZ), and 15 ml ethyl alcohol were added. The flask was attached to a roto-evaporator equipped with a condenser, water aspirator vacuum and a water temperature bath. The slurry was heated with rotation and under vacuum to a bath temperature of 90° C. until all of the alcohol was removed. The mixture was cooled and an addition of 20 ml of 25/25/50 mixture of ethyl acetate/ethyl alcohol/water was added. The slurry was again heated under aspirator vacuum with rotation of the flask for 3 hours maintaining the temperature between 85° C.–90° C. The water temperature was then taken to 95° C. and heated until the solvent was removed. The coated propellant grains were then dried in an oven set at 120° F. for 24 hours.

EXAMPLE 2

In a 100 ml round bottom flask, 50.0 grams of Ex-99 RDX based nitramine gun propellant, 1.5 grams 1,3,5-tris(2-nitroxyethylamino)-2,4,6-trinitrobenzene (PITNE), and 15 ml ethyl alcohol were added. The flask was attached to a roto-evaporator equipped with a condenser, water aspirator vacuum and a water temperature bath. The slurry was heated with rotation and under vacuum to a bath temperature of 90° C. until all of the alcohol was removed. The mixture was cooled and an addition of 20 ml of 25/25/50 mixture of ethyl acetate/ethyl alcohol/water was added. The slurry was again heated under aspirator vacuum with rotation of the flask for 3 hours maintaining the temperature between 85° C.–90° C. The water temperature was then taken to 95° C. and heated until the solvent was removed. The coated propellant grains were then dried in an oven set at 120° F. for 24 hours.

EXAMPLE 3

In a 100 ml round bottom flask, 50.0 grams of Ex-99 RDX based nitramine gun propellant, 1.5 grams 1-(2-nitroxyethylamino)-3-(2-nitroxyethylnitramino)-2,4,6-trinitrobenzene (PINANE), and 15 ml ethyl alcohol were added. The flask was attached to a roto-evaporator equipped with a condenser, water aspirator vacuum and a water temperature bath. The slurry was heated with rotation and under vacuum to a bath temperature of 90° C. until all of the alcohol was removed. The mixture was cooled and an addition of 20 ml of 25/25/50 mixture of ethyl acetate/ethyl alcohol/water was added. The slurry was again heated under aspirator vacuum with rotation of the flask for 3 hours maintaining the temperature between 85° C.–90° C. The water temperature was then taken to 95° C. and heated until the solvent was removed. The coated propellant grains were then dried in an oven set at 120° F. for 24 hours.

The foregoing summary, description, and examples of the present invention are not intended to be limiting, but are only exemplary of the inventive features which are defined in the claims.

What is claimed is:

1. A gun propellant composition comprising:

a propellant grain component; and, an energetic deterrent coating composed of at least one slow burning energetic coated onto the propellant grain component, wherein the at least one slow burning energetic material reduces he burn rate at the surface of the propellant grain and causes the propellant to burn progressively and the energetic deterrent coating comprises a compound selected from the group consisting of TATB, HZTZ, PITNE, PINANE, LLM-105, FOX-7 and combinations thereof.

2. The propellant composition of claim 1, wherein the propellant grain component comprises a propellant grain selected from the group consisting of single base, double base, triple base and nitramine propellants.

3. The propellant composition of claim 1, wherein the energetic deterrent coating comprises a crystalline solid.

4. The propellant composition of claim 1, wherein the energetic deterrent coating comprises a soluble material.

5. The propellant composition of claim 4, wherein the energetic deterrent coating comprises a soluble material of from about 0.05 percent weight per weight of solvent to about 5 percent weight per weight of a solvent.

6. The propellant composition of claim 5, wherein the solvent comprises a liquid solvent selected from the group consisting of water, alcohol, ether, ethyl acetate and acetone.

7. The propellant composition of claim 1, wherein the energetic deterrent coating comprises a high density deterrent.

8. The propellant composition of claim 1, wherein the high density deterrent comprises a density of from about 1.6 $g/cm^3$ to about 2.0 $g/cm^3$.

9. The propellant composition of claim 1, wherein the energetic deterrent coating comprises a organic compound capable of a self-sustaining chemical reaction.

10. The propellant composition of claim 1, wherein the organic compound comprises a functional group selected from the group consisting of amino, nitro, nitramino, hydrazino, azido, nitroxyethylamino, and nitroxyethylnitramino functional groups.

11. The propellant composition of claim 1, wherein the energetic deterrent coating penetrates into the surface of the propellant grain component a distance of from about 0.05 inch to about 0.25 inch.

12. The propellant composition of claim 1, wherein the energetic deterrent coating comprises from about 0.05 percent weight/weight to about 30 percent weight/weight of the propellant composition.

13. The propellant composition of claim 1, wherein the propellant grain component comprises a diameter of from about 0.25 inch to 1.0 inch.

14. The propellant composition of claim 1, wherein the propellant grain component comprises from about 1 to about 19 perforations.

15. A method of manufacturing a gun propellant composition having an energetic deterrent coating, comprising the steps of:

forming a propellant grain component;

dissolving an energetic deterrent coating into a solvent wherein the energetic deterrent coating comprises a compound selected from the group consisting, of TATB, HZTZ, PITNE, PINANE, LLM-105, FOX-7 and combinations thereof; and, applying the dissolved energetic deterrent onto the formed propellant grain component.

16. The method of claim 15, further comprising the step of removing excess solvent with the application of a vacuum.

17. The method of claim 15, wherein the step of applying the dissolved energetic deterrent comprises a spraying of the dissolved energetic deterrent coating onto the propellant grain component.

* * * * *